US007556761B2

(12) United States Patent
Wenzhong

(10) Patent No.: US 7,556,761 B2
(45) Date of Patent: Jul. 7, 2009

(54) PROCESS OF MANUFACTURING CORE-SHEATH COMPOSITE FIBER

(75) Inventor: Gong Wenzhong, Shenzhen (CN)

(73) Assignee: Shenzhen Yang Qian Material Application Technology Co., Ltd., Shenzhen (CN)

( * ) Notice: Subject to any disclaimer, the term of this patent is extended or adjusted under 35 U.S.C. 154(b) by 808 days.

(21) Appl. No.: 10/857,310

(22) Filed: May 28, 2004

(65) Prior Publication Data

US 2004/0217511 A1 Nov. 4, 2004

(51) Int. Cl.
*B29C 45/00* (2006.01)
*B29C 47/00* (2006.01)
*B32B 37/00* (2006.01)

(52) U.S. Cl. ..... 264/510; 264/171.1; 264/171.11; 264/171.12; 264/171.13; 264/171.15; 264/628; 264/629; 264/632; 264/640; 428/373

(58) Field of Classification Search ..... 264/510, 264/171.1, 171.12, 171.13, 172.11, 172.15; 428/373

See application file for complete search history.

(56) References Cited

U.S. PATENT DOCUMENTS

| | | | | |
|---|---|---|---|---|
| 1,681,566 | A * | 8/1928 | Anderegg | 264/171.18 |
| 4,017,030 | A | 4/1977 | Coplan et al. | |
| 4,022,153 | A * | 5/1977 | Rake et al. | 118/68 |
| 4,720,384 | A | 1/1988 | Di Luccio et al. | |
| 5,538,735 | A | 7/1996 | Ahn | |
| 6,021,822 | A | 2/2000 | Izawa et al. | |
| 6,766,817 | B2 | 7/2004 | da Silva | |

FOREIGN PATENT DOCUMENTS

| | | |
|---|---|---|
| CN | 1108583 | 9/1995 |
| CN | 1198196 | 11/1998 |
| CN | 1225960 | 8/1999 |
| CN | 1063805 | 3/2001 |

* cited by examiner

*Primary Examiner*—Christina Johnson
*Assistant Examiner*—Stella Yi
(74) *Attorney, Agent, or Firm*—Morris, Manning & Martin LLP; Tim Tingkang Xia

(57) ABSTRACT

A process of manufacturing core-sheath composite fiber includes the steps of: preparing hollow fiber in a form of filament of which some parts forms communicating pores from an outer surface of the fiber to a hollow portion thereof, or in a form of filament segment with open ends; sealing adjacent porous parts or open ends of the same filament respectively in pressure containers and vacuum containers; adding filling materials into pressure containers, and keeping the porous parts or open ends completely immersed in the filling materials; pressurizing the pressure containers using compressed gas, and evacuating the vacuum containers, then the filling materials being absorbed through the communicating pores or opens into the hollow portion of the fiber. During the process of the present invention to manufacture core-sheath composite fiber, most areas of outer surface of the fiber do not contact the filling materials, thus most areas of the outer surface is clean, which is advantageous for post treating or use. The process of the present invention is applicable for filling various materials at a broad range temperature.

19 Claims, 1 Drawing Sheet

PROCESS OF MANUFACTURING CORE-SHEATH COMPOSITE FIBER

BACKGROUND OF THE INVENTION

1. Field of the Invention

The present invention relates to a process for filling a hollow portion of a hollow filaments with filling materials composed of functional material, and more particularly to a method for filling a hollow portion of a hollow fiber of which only parts or ends are submerged in the filling materials.

2. Description of Related Art

The traditional processes of making core-sheath fiber include various composite spinning methods. In those processes, including melt-spinning or wet-spinning, a high temperature or a special solvent is necessary. However, most of functional materials, particularly drugs, fragrance, and biochemical materials, are sensitive to temperature or solvent, and such a high temperature or the solvent may affect or destroy the performance of the functional materials, as a result, the application of many kinds of functional materials is limited in the traditional spinning process. Therefore, the kinds of functional fiber produced by the use of the traditional spinning process are limited.

To solve the above question, Chinese patent application Publication No. CN1225960 discloses an immersion method, in which porous hollow fiber is immersed in a solution of functional materials, thus the fragrance with a low boiling point can be filled into the hollow fiber. U.S. Pat. No. 6,021,822, Chinese application publication No. CN1198196, and the cited references thereof, also disclose a method for encapsulating functional materials into porous hollow fiber using the immersion process, thus many kinds of functional materials with temperature sensitive cannot be composite with the hollow fiber using these processes. Furthermore, when using the above method, most areas of the hollow fiber, and even all of the length of the hollow fiber, should be formed communication pores. Washing is also necessary after filling the hollow fiber to remove the remained functional materials and auxiliary materials on the surface of the fiber. Post processing cannot carry out until washing is performed. Obviously, those processes are relatively complicated. Furthermore, washing will affect, even destroy the functional materials filled in the hollow portion. Therefore, the kinds of functional materials to be filled are still limited; as a result, the kinds of the functional fiber produced with above method are still limited.

U.S. Pat. No. 5,538,735 and Chinese application Publication No. CN1108583 disclose a method of filling drugs or film forming materials into the hollow portion of the fiber using vacuum facilities, comprises the steps of: submerging the fibers in a liquid containing the drugs or film forming materials, placing the submerged fibers in a vacuum chamber, drawing air out of the void of the fiber by withdrawing the air in the vacuum chamber, and drawing the liquid into the void by allowing the air pressure in the vacuum chamber return to the ambient pressure. Some drugs or film forming materials can be incorporated in the hollow portion of the fiber at a room temperature. However, during filling, the hollow fibers are completely submerged in the liquid of filling materials, thus large amounts of filling materials must be used, which cause high cost, particularly for valuable pharmaceuticals, fragrance, or other valuable functional materials. This disadvantage is most outstanding for mass production. Furthermore, this process is not suitable for filling volatile materials because of the evacuation of the vacuum chamber, in which there are liquid containing volatile material. Additionally, washing process is also necessary after filling for the post treatments.

U.S. Pat. No. 4,017,030 discloses a device comprising an elongated capillary conduit having one closed end for absorbing a flower-like odor or insecticide from an open ends thereof by capillary action, thus the follower-like odor or insecticide being incorporated in the device to be released as vapors. However, only such a liquid with a low viscosity can be filled, or the length of the hollow fiber to be filled is limited. When the filled materials have a high viscosity, or a long hollow fiber is filled, this device will not be suitable.

Generally, the process of manufacturing composite fiber is not finished only after the functional materials are incorporated into the hollow portion of the hollow fiber. For making most kinds of functional fiber, a subsequent chemical or physical treatment is necessary to cause physical change or chemical reaction of the filled functional materials or auxiliary materials. Such treatments include curing or gelatinizing the functional materials and auxiliary materials in the hollow portion, thus forming precipitation in the hollow portion or coating at the inner wall of the fiber, and etc. Generally, after the fiber is filled using the immersion or vacuum immersion process, the subsequent treatments cannot be performed without washing the surface of the fiber. However, the functional materials and auxiliary materials filled in the hollow fiber will be easily lost or destroyed during washing, and the property imparted by the functional materials will become reduced in storage or in use since the communicating pores or open ends of the fiber are not sealed yet. Furthermore, filling function materials using capillarity action, not only the filled materials and the length of the fiber are limited, but also the liquid filled in the hollow portion will move during post treatments since one end of the fiber is open, therefore, some segments in the hollow portion of the fiber are out of filling material, and forms voids without filling materials. As a result, a uniformly filled fiber cannot be produced.

In view of the foresaid, the methods described as above can just be applicable when no post treatment is necessary after the functional materials and auxiliary materials are incorporated in the hollow fiber. Moreover, the kinds of functional and auxiliary materials, and the length of the fiber to be filled are limited.

Therefore, an improved method of manufacturing core-sheath composite fiber is desired which overcomes the disadvantages of the prior art.

SUMMARY OF THE INVENTION

A main object of the present invention is to provide a process of manufacturing core-sheath composite fiber, wherein most of outer surface of the fiber does not contact filling materials, thus keeping clear.

To obtain the above object, a process of manufacturing core-sheath composite fiber of the present invention comprises the steps of: preparing a hollow fiber in a form of filament of which some parts form communicating pores from an outer surface to a hollow portion thereof, or in a form of filament segment with open ends; sealing adjacent porous parts or open ends of the same filament respectively in pressure containers and vacuum containers; adding filling materials into pressure containers, and keeping the porous parts or open ends in the pressure containers completely immersed in the filling materials; pressurizing the pressure containers using compressed gas, and evacuating the vacuum containers, then the filling materials being absorbed through the communicating pores or opens immersed in the filling material added in the pressure containers into the hollow portion of the fiber.

Other objects, advantages and novel features of the invention will become more apparent from the following detailed description of a preferred embodiment thereof when taken in conjunction with the accompanying drawings, wherein:

DETAILED DESCRIPTION OF THE INVENTION

Figure 1:
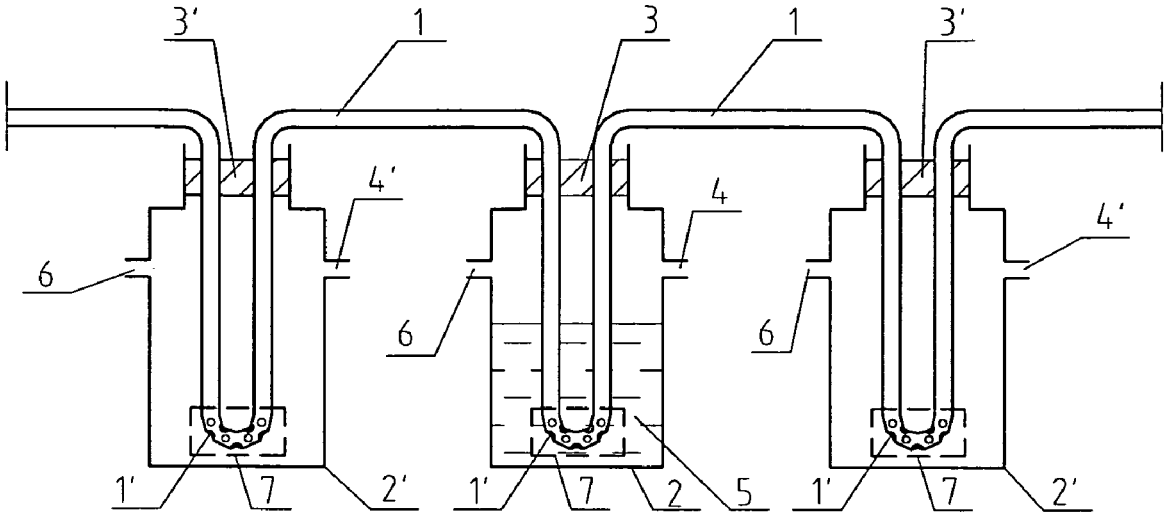
FIG. 1 is a schematic diagram of an arrangement for manufacturing core-sheath composite fiber.

Referring now to the drawings in detail, FIG. 1 shows a process of filling a fiber 1 with a filling materials 5 composed of functional materials. The fiber 1 in this embodiment can take a form of filament or filament segment. The fiber 1 has a hollow portion therein. Parts 7 are the porous areas of the fiber 1 in the form of filament, and define communicating pores 1' from outer surface to the hollow portion. Each two adjacent parts 7 are longitudinally spaced at a predetermined distance. Each part 7 defines one or more than one pores therein. If the fiber 1 is in a form of filament segment, each part 7 defines one or more open ends and 1' designates the opens at the ends, and 7 designates the ends. A system for the process of filling the hollow fiber 1, as shown in FIG. 1, includes a pressure container 2 with an input port 4 of compressed gas and an inlet/outlet 6 of filling materials, and a vacuum container 2' with an output port 4' of air for vacuum pumping and an inlet/outlet 6. The pressure containers 2 and vacuum containers 2' are discommunicated each other during the process of filling in the present invention. It is understood that more or less containers 2, 2' may be used according to the length or the form of the hollow fiber to be filled. The filling material 5, in a form of gas, liquid, solution, emulsion, and suspension, is composed of functional materials and auxiliary materials if desired, and can be introduced into the pressure container 2 via inlet 6. Predetermined segments of the hollow fiber 1 are sealed in the containers 2, 2' using sealing gum 3, 3', leaving other segments of the hollow fiber 1 without pores or opens outside the containers 2, 2', so that the porous parts or the open ends 7 thereof are positioned in containers 2, 2' and extend to the bottom of the containers 2, 2'. Specifically speaking, each two adjacent porous parts 7 are respectively located in one pressure container 2 and one vacuum container 2'. Similarly, the two ends of the fiber 1 in the form of filament segment are respectively located in one pressure container 2 and one vacuum container 2'. The porous parts or open ends 7 in containers 2 are completely submerged in the filling materials 5. The container 2 is pressurized using compressed gas, and the container 2' is evacuated, thereby the filling materials 5 is filled through the communicating pores or opens 1' into the hollow portion of the fiber 1. Thereafter, the segments of the fiber 1 outside the containers 2, 2' undergo chemical or physical treatment if necessary. Then, the core-sheath composite fiber is obtained. Mass production is possible when filling unit as shown in FIG. 1. is repeated, or proper sealing methods in art are used.

The hollow fiber 1 used in the present invention can be made of polymer or inorganic materials, such as polypropylene, polyester, polyamide. The hollow fiber 1 may take a form of a filament or multifilament with a single hole or multi-holes, which may be located in fiber products, or other appropriate materials. The fiber may contain an anti-static agent, fluorescent whiteness enhancer, stabilizer, anti-oxidant agent, flame-retardant agent, catalyst, anti-coloring agent, heat resistant agent, coloring agent, and organic or inorganic particles etc. Surface of the fiber can be smooth, or be in a regular or irregular shape.

The hollow fiber 1 can be produced by any publicly known techniques, and the method to produce communicating pores 1' from the surface to the hollow portion of the fiber 1, or to produce the opens 1' at the ends of the fiber 1, includes various chemical or physical methods, such as the methods described in U.S. Pat. No. 5,538,735 and Chinese Pat. Publication No. CN1063805.

The functional materials of the present invention are inorganic functional materials, organic functional materials, biological activity materials, pharmaceuticals, and fragrance etc., which can become liquid, solution, emulsion, or suspension using physical or chemical treatments. For instance, various functional pigment, field reactive materials, biologic enzyme and cell, Western medicine or Chinese traditional medicine, and olein extracted from of animals or plants may be used.

The auxiliary materials of the present invention can help the functional materials to perform the functional property thereof, and help to manufacture the functional fiber. Such auxiliary materials can dissolve, emulsify, or disperse the functional materials. The auxiliary materials comprise organic or inorganic materials, or materials with biological activity, for instance, solvent, surfactants, monomer, polymer, initiator, catalyst, organic or inorganic filler, etc. According to the kinds of the functional fiber to be produced, the auxiliary material can act as the solvent of the functional material to liquefy, emulsify, or disperse the same, act as a filler or framework material to fix the functional materials in the hollow portion of the hollow fiber 1, act as carrier which will be removed by chemical or physical methods after the functional materials are delivered into the hollow portion therewith, act as protective substance for the functional materials to protect the functional property of the same from being reduced during manufacturing, storage, or application of the composite fiber, and act as activating agent or control component for the functional property of the functional materials. One or more than one kinds of auxiliary materials may be used to produce composite fiber of the present invention.

The sealing gum 3, 3' of the present invention can be natural gum or synthetic gum, including reactive gum, solvent gum, emulsion gum, thermoplastic gum. The sealing gum 3, 3' can well seal the fiber 1 in the containers 2, 2', and is well solvent resistant, acid and alkali resistant, and oil resistant. The kinds of the sealing gum 3, 3' may be the same or not.

The filling materials 5 composed of functional materials and auxiliary materials are incorporated through the communicating pores or opens 1' immersed in the filling material added in the container 2 into the hollow portion of the fiber 1 to form the core, under a pressure difference between the two adjacent parts 7 with communicating pores in a form of filament, or under a pressure difference between ends 7 with opens 1' of the same fiber 1 in a form of filament segment.

It is well known that when a liquid flows through a round tube, if the Reynolds number of the liquid is sufficiently small, the pressure loss is expressed by the Hagen-Poiseuille equation (1):

$$\Delta P = 8LQ\eta/AR^2 \quad (1)$$

where ΔP represents the pressure loss, L the length of liquid which moves through the interior of the round tube, η the viscosity of the flowing liquid, R the internal radius of the round tube, and A the cross-sectional area of the round tube. The following equation (2) is obtained form the equation (1):

$$t=4\eta L^2/(\Delta PR^2) \quad (2)$$

It is understood from the equation (2) that the time necessary for a liquid or emulsion or suspension, to completely transfer into the hollow portion of a hollow fiber is proportional to the viscosity of that liquid and to the square of the length of a communicating pore, and is inversely proportional to the square of the internal radius of the hollow fiber. Therefore, if the length of the hollow fiber 1, the diameter of the hollow portion, and the viscosity of the filling materials 5 are properly chosen, the filling time will be predicted under a predetermined pressure loss.

This suggests that, the time necessary for the filling materials 5, to completely transfer into the hollow portion of a hollow fiber can be reduced when the pressure during filling is increased through choosing proper sealing gum 3, 3' and sealing method, or a proper auxiliary materials are used for reducing the viscosity of the filling materials 5.

It is understood that, when a proper sealing method is used in the present invention, the system for filling the fiber 1 as shown in FIG. 1 can be heated to melt some special functional materials, or be cooled for liquefying some special functional materials being gaseous at normal temperature and pressure, thereby, various special functional materials can be incorporated with the hollow fiber to form the core-sheath structure using the process of the present invention.

The process of manufacturing composite fiber with a core-sheath structure comprises the steps of:

(1) preparing hollow fiber 1 in a form of filament or filament segment, wherein, in a form of filament, communicating pores 1' are produced in parts 7 of the fiber 1 from a surface of the sheath to the hollow portion, wherein, in a form of filament segment, opens 1' are formed at each end 7 of the fiber 1 and are communicated with the hollow portion, and a longitudinal distance between each two adjacent parts 7 of the same fiber 1, or a length of the fiber 1 in a form of filament segment, is preferably in a range of 0.1 meter to 100 meters;

(2) applying filling materials, i.e. the filling materials 5, being composed of functional materials with or without auxiliary materials;

(3) respectively sealing the adjacent porous parts or open ends 7 of step (1) in containers 2, 2' using sealing gum 3, 3';

(4) adding filling materials of step (2) into containers 2 of step (3), keeping the porous parts or open ends 7 in the container 2 to be completely immersed in the filling materials 5 therein, (5) pressurizing the containers 2 using compressed gas, and evacuating containers 2', thereby a pressure difference exists between the two adjacent porous parts or open ends 7, then the filling materials 5 being filled through the communicating pores or opens 1' immersed in the filling added in the container 2 into the hollow portion of the fiber 1 of step (1), a core-sheath fiber being formed therefore; and (6) adjusting the air pressure in the containers 2, 2' to the same pressure level, chemically or physically treating the core-sheath fiber of step (5) which is located outside the containers 2, 2' and then cutting the treated fiber, or directly cutting the fiber outside the container 2, 2' without treating, a core-sheath functional fiber being formed.

During the process of filling, most areas of the outer surface of the fiber do not contact with the filling materials since most length of the fiber is located outside the containers 2,2', therefore, most outer surface of the fiber is clean, and can be directly treated. On the other hand, the segments of the fiber 1 inside the containers 2, 2' and the segments contacting with gum 3,3', may be washed, then being post treated or not, therefore, a long continuous fiber is obtained. Such post treatments include heating, cooling, curing, surface coating, microwave treating, and so on. The process of the present invention is applicable for more kinds of functional materials to be composite with the fiber, thus more kinds of functional fiber may be obtained.

EXAMPLES

This invention will be described below specifically with reference to examples, but this invention must not be limited to those examples.

Example 1

Example 1 describes the method of manufacturing a core-sheath fluorescent fiber.

In step (1) of producing porous hollow fiber 1 in a form of filament, the hollow fiber 1 can be produced by any publicly known techniques, for example, by the method described in Chinese Pat. Publication No. CN1063805. The fiber 1 is made from 100D/24F polyester, and a hollowness ratio thereof is 25%. The length between two adjacent parts 7 of the same fiber 1 is about 3 meters, and there are three parts 7 in total in this example. Each part 7 defines communicating pores 1' from the surface to the hollow portion. The communicating pore 1' has a width of 0.5-2 μm, and a length of each porous part 7 is in a range of 5 to 20 μm. Fifty 100D/24F multifilaments are used as a multifilament bundle with their porous parts 7 being arrayed.

In step (2) of preparing sealing gum 3, 3', wherein 30 parts industrial gelatine by weight and 30 parts glycerin by weight are dissolved in 75 parts hot water by weight at a temperature of 60 degrees centigrade. Thus, the sealing gum is obtained, maintaining the temperature of the same at a range of 50 to 60 degrees centigrade.

In step (3) of partly sealing the multifilament in the containers 2, 2', wherein three segments of multifilament bundle each with a porous part 7, are respectively sealed in three containers using the gum of step (2), extending the porous part 7 to the bottom of the containers, then cooling the gum to a room temperature.

In a step (4) of preparing liquid 5, 3-6 wt. % of Benzoin aether, and 0.01-0.1 wt. %, preferably 0.05-0.08 wt. % of fluorescent dye Rhodamine 6G are completely dissolved in tri(ethylene glycol) dimethacrylate, thus forming liquid 5 composed of functional dye and auxiliary materials, wherein the weight percents are relative to the total weight of tri (ethylene glycol) dimethacrylate.

In step (5), liquid 5 of step (4) is added into one container 2 as shown in FIG. 1 through the inlet 6 thereof, and the porous part 7 are completely submerged in the liquid 5 in the container 2 during filling.

In step (6) of filling, compressed air is introduced into the container 2 through the input port 4 thereof till the pressure inside the container 2 gets to $2\times10^5$ Pa, while the other two containers 2' at both sides of the container 2 are evacuated. Such pressurizing and evacuating maintain about 40 minutes till the liquid expels from the pores of the fiber in containers 2'. Then, the vacuum degree in containers 2' and the pressure in container 2 are both reduced, and the pressure level of the containers 2, 2' is adjusted to the same pressure level. The pressure level is $1\times10^5$ Pa of this example.

In step (7) of post treatment, the segments of the filled fiber of step (6) outside containers 2, 2' are irradiated using ultraviolet light with a power density of $700\times10^{-3}$ W/cm$^2$ and at a wavelength of 365 nm. Each filament of the multifilament is completely shined about 3 minutes. Thereby, tri(ethylene glycol) dimethacrylate filled in the hollow portion of the fiber are cured at the core of the fiber. Thereafter, the segments of fiber cured by ultraviolet light are cut, thus, the core-sheath fluorescent fiber is obtained, which shows red fluorescence under ultraviolet light.

Example 2

Example 2 describes the process of manufacturing a self-sealing fragrance release fiber as follows.

Steps (1) to (3) of this Example are corresponsive to Example 1.

In step (4), narcissus oil, rose oil, and osmanthus oil are mixed at a volumetric ratio 1:3:1 to form fragrance. Polyvinylpyrrolidone (K-15), absolute ethyl alcohol, and glycerin are mixed respectively at a weight percent 15%, 10%, and 5% of the total weight of the fragrance, then the mixture are added to the fragrance. Thus the liquid 5 to be filled is obtained.

Steps (5) to (6) are corresponsive to the Example 1.

In step (7), the segments of the filled fiber are cut into different length according to the time of fragrance release. Thus, a sleeping-inducing fragrance release fiber is obtained, which can be composite with other textile. The solid concentrate in the fiber becomes higher with the release of fragrance. The fiber self seals, thus the rate of fragrance release being gradually reduced.

Example 3

This example illustrates the process to manufacture 2-(2,6-dichloroanilino)-2-imidazoline hydrochloride release fiber.

Steps (1) to (3) of this Example are corresponsive to Example 1.

In step (4), 5 wt. % of Polyvinylpyrrolidone (K-15) and 60 wt. % of 2-(2,6-dichloroanilino)-2-imidazoline hydrochloride are dissolved in absolute ethyl alcohol to produce the liquid 5, wherein the weight percents are relative to the total weight of absolute ethyl alcohol.

Steps (5) to (6) are corresponsive to the Example 1.

In step (7), the segments of the filled fiber are cut into different length according to the time of the drug release. The antihypertensive drug can be surgically delivered through the skin to human body. In use for curing hypertension, 2-(2,6-dichloroanilino)-2-imidazoline hydrochloride is gradually released from the core of the fiber, and dissolved in the moisture of human skin surface, then enters human body. The dosing times and rate of drug release can be controlled when the dose and components of auxiliary materials, the size of the fiber, and post treatments are properly chosen.

Example 4

This example discloses a method to manufacture UV-curing fragrance release fiber.

In step (1) of producing hollow fiber 1 in a form of multifilament segment, the hollow fiber 1 can be produced by any publicly known techniques, for example, by the method described in U.S. Pat. No. 5,538,735. The fiber 1 is made from 100D/24F polyester multifilament, and a hollowness ratio thereof is 25%. The multifilament is cut into segments. Fifty 100D/24F multifilament segments, each in a length of 3 meters and with open ends 7, are prepared as a multifilament bundle with their ends 7 being arrayed. Each end 7 has an open 1' communicating with the hollow portion.

In step (2) of preparing sealing gum 3, ethylene-vinyl acetate copolymer (EVA28/250) and common paraffin are mixed at a temperature of 120 degrees centigrade and at a mass rate of 5:1. The obtained sealing gum 3 is maintained at a temperature of 90 degrees centigrade.

In step (3) of sealing the ends of the hollow multifilament segments in the containers 2, 2', wherein both ends 7 are respectively sealed in one container 2 and one container 2' using the gum 3 of step (2), and are extended to the bottom of the containers, then cooling the gum 3 to a room temperature.

In a step (4) of preparing liquid 5, 5 wt. % of methyl methacrylate and 15 wt. % of butyl methacrylate are added to lavender oil to form a mixture, wherein the weight percent is relative to the total weight of lavender oil. 6 wt. % of Benzoin aether is added to the mixture and completely dissolved, wherein the weight percent is relative to the total weight of methyl methacrylate and butyl methacrylate in the mixture. Thereby, liquid 5 composed of fragrance and auxiliary materials is prepared.

In step (5), liquid 5 of step (4) is added into the container 2 through the inlet 6 thereof, and the ends of hollow multifilament segments are completely immersed in the liquid 5 in the container 2.

In step (6) of filling, compressed air is introduced into the container 2 through the input port 4 thereof till the pressure inside the container 2 gets to $3\times10^5$ Pa, while the container 2' is evacuated. Such pressurizing and evacuating maintain about 50 minutes till the liquid expels from the open of the ends of filaments in containers 2'. Then, the vacuum degree in containers 2' and the pressure in container 2 are both reduced, and the pressure level of the containers 2, 2' are adjusted to the same pressure level. The pressure level is $1\times10^5$ Pa of this example.

In step (7) of post treatment, the segments of the filled multifilament of step (6) outside containers 2, 2' are irradiated using ultraviolet light with a power density of $700\times10^{-3}$ W/cm$^2$ and at a wavelength of 365 nm. Each filament in the bundle is completely shined about 5 minutes, thereby, methyl methacrylate and butyl methacrylate filled in the hollow portion are cured to forming gel, and phase separation between the fragrance and the auxiliary materials performs. The segments of fiber are cut after treatment, thus, the core-sheath lavender oil fragrance release fiber is obtained. Since, the gel in the core of the fiber is not compatible with water, and the fragrance is absorbed in the gel, the time of release fragrance is longer than that of example 2. A long acting fragrance release fiber can be obtained using this method when auxiliary materials are properly chosen.

Example 5

The example illustrates the method to manufacture photochromic fiber.

Steps (1) to (3) of this Example are corresponsive to Example 4.

In step (4), 2 wt. % 1',3'-Dihydro-1',3',3'-trimethyl-6-nitrospiro[2H-1-benzopyrane-2,2'-(2H)-indole] and 0.1 wt. % of azobisisobutyronitrile are dissolved in methyl methacrylate to form the liquid 5, wherein the weight percents are relative to the total weight of methyl methacrylate. The obtained solution is composed of photochromic functional materials and auxiliary materials.

Steps (5) to (6) are corresponsive to the Example 4.

In step (7), the segments of the fiber outside of the containers 2, 2' are heated at a temperature of 60 degrees centigrade for 40 minutes, then the temperature being raised to 90 degrees centigrade for 20 minutes. Therefore, a core-sheath photochromic fiber is obtained. When the photochromic fiber is irradiated using ultraviolet light for 10-20 seconds, the color thereof will turn to claret from white, and the claret will disappear if the fiber is placed in dark for about 2 hours, or is heated again. This color-changing process of the photochromic fiber of the present invention is repeatable.

Example 6

This example illustrates a process to manufacture core-sheath filament with silver coating at the inner wall.

Steps (1) to (3) of this Example are corresponsive to Example 4, but the temperature of the fiber and containers 2,2' are maintained at 5 degrees centigrade.

In step (4), ammonia water at a concentration of 5% is added into 35 parts by weight solution of silver nitrate at a concentration of 10% until the precipitation in their mixture disappears, and herein, the ammonia water is used about 45 parts by weight. The mixture is placed in a cool water bath at a temperature of 5 degrees centigrade. Then 20 parts by weight of a solution of glucose at a concentration of 10% are added into the mixture, therefore, the filling liquid 5 is obtained.

In step (5), liquid 5 of step (4) is added into the container 2 through the inlet 6 thereof, and the ends of hollow filament segments are completely immersed in the liquid 5 in the container 2.

Steps (6) of this Example is corresponsive to Example 4, but the time for pressurizing and evacuating approximately maintains 30 minutes.

In step (7), the segments of the filled filament outside the containers 2, 2' are rapidly heated to a temperature of 80 degrees centigrade, therefore, the color of the filled fiber turn to dust color, and the inner wall of the hollow portion is coated with silver.

In step (8), residual filling liquid 5 is discharged from containers 2,2' and the container 2,2' are washed using water. Then container 2 is added enough water and is pressurized, and the container 2' is evacuated. The water flows from the hollow portion with silver coating to remove the by-product during coating silver from the hollow portion for cleaning the coated fiber. Then the segments of the fiber outside the containers are cut and dried. Finally, the fiber with silver coating at the inner wall of the hollow portion is formed, which has excellent antibiotic and antisepsis property.

When the filling materials 5 are pure liquid or melted to liquid, or the filling materials 5 are gas, the process of the present invention is applicable to make composite fiber with the same.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A process of manufacturing core-sheath composite fiber comprising the steps of:

(1) preparing a hollow fiber in a form of filament or filament segment, wherein, in a form of filament, communicating pores are produced in parts of the fiber from an outer surface to a hollow portion of the fiber, wherein, in a form of filament segment, open is formed at each end of the fiber;

(2) preparing filling material which is composed of functional materials;

(3) sealing the porous parts or open ends of step (1) in pressure containers or in vacuum containers using sealing gum, keeping adjacent porous parts or the two open ends of the same fiber respectively sealed in the pressure container and in the vacuum container, wherein the vacuum containers are separated from the pressure containers;

(4) adding filling material of step (2) into pressure containers of step (3), thereby, keeping the porous parts or open ends in the pressure containers completely immersed in the filling materials therein, and leaving some segments of the hollow fiber between the adjacent pressure containers and the vacuum containers exposed to the atmosphere; and (5) pressurizing the pressure containers using compressed gas, and evacuating the vacuum containers, thereby a pressure difference existing between the two adjacent porous parts or open ends, then the filling material flowing from the communicating pores or opens immersed in the filling material added in the pressure containers to the adjacent porous parts or open ends in the vacuum containers, thereby filling the filling material into the hollow portion of the fiber of step (1), core-sheath composite fiber being formed therefore.

2. The process as claimed in claim 1, further comprising a step of post treating the core-sheath composite fiber of step (5) which is located outside the pressure and vacuum containers.

3. The process as claimed in claim 2, wherein, after post treating, segments of the filled fiber of step (5) outside the pressure and vacuum containers are cut.

4. The process as claimed in claim 2, wherein, during post treating, pressure both in the pressure containers and the vacuum containers is controlled at the same pressure level.

5. The process as claimed in claim 2, wherein the post treating comprises heating, cooling, drying, surface coating, microwave treating, or curing.

6. The process as claimed in claim 1, further comprising a step of washing parts of the core-sheath fiber of step (5) which contact the sealing gum and the filling material.

7. The process as claimed in claim 6, further comprising a step of post treating the whole fiber after washing.

8. The process as claimed in claim 1, wherein said hollow fiber is made from polymer materials, or inorganic materials, and takes a form of filament or multifilament with single hole or multi-holes.

9. The process as claimed in claim 1, wherein said functional materials are inorganic functional materials, organic functional materials, biological activity materials, pharmaceuticals, or fragrance.

10. The process as claimed in claim 9, wherein said functional materials have at least one component selected from the group of functional pigment, field reactive materials, biologic enzyme and cell, Western medicine or Chinese traditional medicine, and olein extracted from of animals or plants.

11. The process as claimed in claim 1, wherein said filling materials are in a form of gas, liquid, solution, emulsion, or suspension.

12. The process as claimed in claim 1, wherein said filling materials further comprise auxiliary materials.

13. The process as claimed in claim 12, wherein said auxiliary materials are organic or inorganic materials, or biological materials.

14. The process as claimed in claim 12, wherein said auxiliary materials have at least one component selected from the group of solvent, surfactants, monomer, polymer, initiator, catalyst, and organic or inorganic filler.

15. The process as claimed in claim 1, wherein a longitudinal distance between each two adjacent porous parts of the same fiber in a form of filament, or a length of the fiber in a form of filament segment, is in a range of 0.1 meter to 100 meters.

16. The process as claimed in claim 1, wherein the core-sheath fiber which is located outside the pressure containers and vacuum containers is cut after step (5).

17. A process of manufacturing core-sheath composite fiber comprising the steps of:

(1) preparing a hollow fiber in a form of filament or filament segment, wherein, in a form of filament, communicating pores are produced in parts of the fiber from an outer surface to a hollow portion of the fiber, wherein, in a form of filament segment, open is formed at each end of the fiber;

(2) preparing filling material which is composed of functional materials;

(3) sealing the porous parts or open ends of step (1) in pressure containers or in vacuum containers using sealing gum, keeping adjacent porous parts or the two open ends of the same fiber respectively sealed in the pressure container and in the vacuum container;

(4) adding filling material of step (2) into pressure containers of step (3), thereby, keeping the porous parts or open ends in the pressure containers completely immersed in the filling materials therein, and leaving some segments of the hollow fiber between the adjacent pressure containers and the vacuum containers without pores or opens exposed to the atmosphere; and (5) pressurizing the pressure containers using compressed gas, and evacuating the vacuum containers, thereby a pressure difference existing between the two adjacent porous parts or open ends, then the filling material being filled through the communicating pores or opens immersed in the filling material added in the pressure containers into the hollow portion of the fiber of step (1), core-sheath composite fiber being formed therefore.

18. The process as claimed in claim 17, wherein the pressure difference existing between the two adjacent porous parts or open ends is in a range of about $1\times10^5$ Pa to $3\times10^5$ Pa.

19. The process as claimed in claim 17, wherein the sealing gum is selected from the group consisting of: a solvent gum, an emulsion gum, and a thermoplastic gum.

* * * * *